US006533446B2

(12) United States Patent
Chen et al.

(10) Patent No.: US 6,533,446 B2
(45) Date of Patent: Mar. 18, 2003

(54) OMNIDIRECTIONAL LIGHT WITH PROTECTED IN-GROUND LIGHT SOURCE

(75) Inventors: Yuming Chen, Manasquan, NJ (US); Michael J. Kirchoff, Wall, NJ (US); Robert L. Martin, Little Silver, NJ (US)

(73) Assignee: Dialight Corporation, Manasquan, NJ (US)

( * ) Notice: Subject to any disclaimer, the term of this patent is extended or adjusted under 35 U.S.C. 154(b) by 92 days.

(21) Appl. No.: 09/783,952

(22) Filed: Feb. 16, 2001

(65) Prior Publication Data

US 2002/0114170 A1 Aug. 22, 2002

(51) Int. Cl.[7] ..... F21V 5/00

(52) U.S. Cl. ..... 362/559; 362/153.1; 362/145; 362/576; 362/551

(58) Field of Search ..... 362/559, 153.1, 362/470, 145, 576, 551, 560

(56) References Cited

U.S. PATENT DOCUMENTS 2,420,772 A * 5/1947 Dalton ..... 343/720
2,614,203 A * 10/1952 Dalton, Jr. et al. ..... 362/559
5,105,347 A * 4/1992 Ruud et al. ..... 362/268
5,134,550 A * 7/1992 Young ..... 362/560
5,406,466 A * 4/1995 Stokes ..... 362/153.1
5,436,812 A * 7/1995 Stewart ..... 362/153.1
6,168,294 B1 * 1/2001 Erni et al. ..... 362/298
6,280,057 B1 * 8/2001 O'Meara ..... 362/259

* cited by examiner

*Primary Examiner*—Sandra O'Shea
*Assistant Examiner*—Ronald E. DelGizzi
(74) *Attorney, Agent, or Firm*—Oblon, Spivak, McClelland, Maier & Neustadt, P.C.

(57) ABSTRACT

A light, such as for an airport taxiway, in which a base includes a light source which outputs light. The light source may be an LED (light emitting diode) light source which is highly energy efficient and which has a long life. A light guide receives and guides light output from the light source. The light guide further extends out from the light source. A reflector is positioned in the light guide and reflects the light guided through the light guide to provide the appropriate illumination.

27 Claims, 4 Drawing Sheets

OMNIDIRECTIONAL LIGHT WITH PROTECTED IN-GROUND LIGHT SOURCE

BACKGROUND OF THE INVENTION

1. Field of the Invention

The present invention is directed to an omnidirectional light with a protected light source which may find various applications, for example in one particular application as an edge light for use along an airport taxiway.

2. Discussion of the Background

There are many instances in which a light is utilized to illuminate an edge of an area, and in which that edge light may be susceptible to damage. As one specific example, an airport taxiway edge light is used to illuminate an edge of a taxiway area for airplanes at an airport. However, such edge lights are often susceptible to damage from various vehicles. In the instance of an airport taxiway edge light, an aircraft itself may strike the edge light and break it. Also, a particular hazard may be snow plows striking the edge light.

Conventionally, such edge lights are formed of fixtures containing incandescent light bulbs positioned at the edge of the area to be illuminated, such as the edge of an airport taxiway. Also, the light sources are above ground and susceptible to damage. An obvious problem with such conventional edge lights is the cost of replacement when they are struck by aircraft, snow plows, etc.

Also, conventional incandescent lamps have relatively short lifetimes, and as a result such edge lights often have to be replaced, and such incandescent lamps are not highly energy efficient.

OBJECTS OF THE INVENTION

Accordingly, one object of the present invention is to provide a novel light construction in which replacement is simplified when such lights become struck by vehicles.

A further object of the present invention is to provide a novel light structure in which general maintenance and energy use costs are reduced.

A further object of the present invention is to provide a novel light structure in which the enhanced replaceability, enhanced durability, and reduced power consumption are achieved in an economical manner.

SUMMARY OF THE INVENTION

The present invention achieves the above and other objects by providing an omnidirectional light, such as an edge light for an airport taxiway, in which a base at or below grade includes a light source which outputs light. In a preferred embodiment the light source includes LEDs (light emitting diodes) which are highly energy efficient and which have a long life. A light guide receives and guides light output from the light source. The light guide further extends out from the light source. A reflector is positioned in the light guide and reflects the light guided through the light guide to provide the appropriate edge illumination.

Furthermore, the novel light of the present invention may have a construction that the base which includes the light source is provided underground and the light guide extends out from the base above ground and is connected to the base by a frangible coupling. With such a construction, if a vehicle strikes the light guide, the light guide will break away from the base at the defined breakpoint of the frangible coupling. Repairing such a struck edge light then merely requires replacement of the light guide and does not require replacement of the more expensive light source, which in the preferred embodiment includes LEDs and driving circuitry.

Further, the use of LEDs as the light source provides a light source which is more energy efficient and which has a longer lifetime than incandescent lamp lights, to thereby reduce maintenance and operating costs.

Further, the novel light of the present invention may find use as walkway lights, recreational trail lights, or similar such lights.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
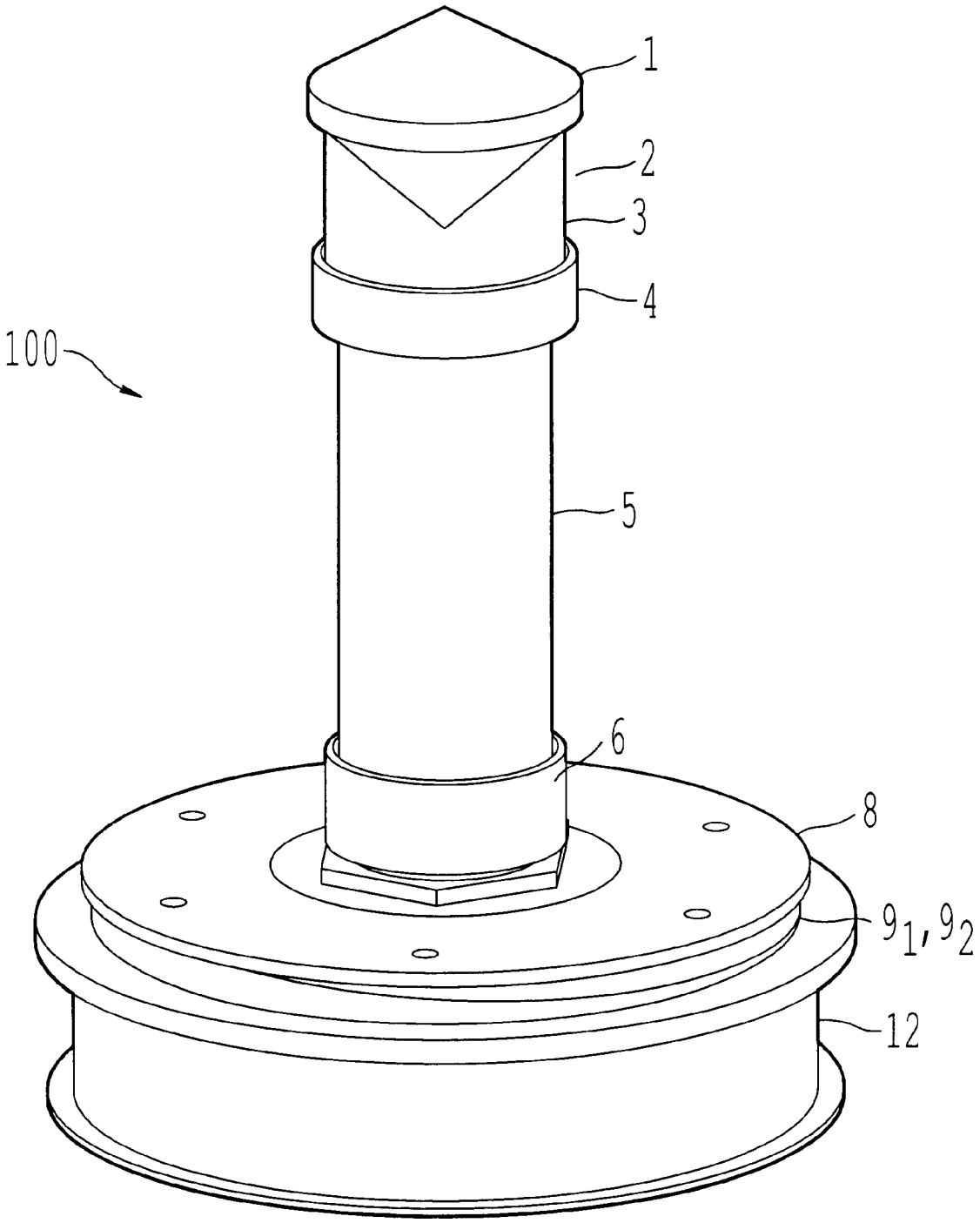
FIG. 1 shows the novel light of the present invention in an oblique view.
Figure 2:
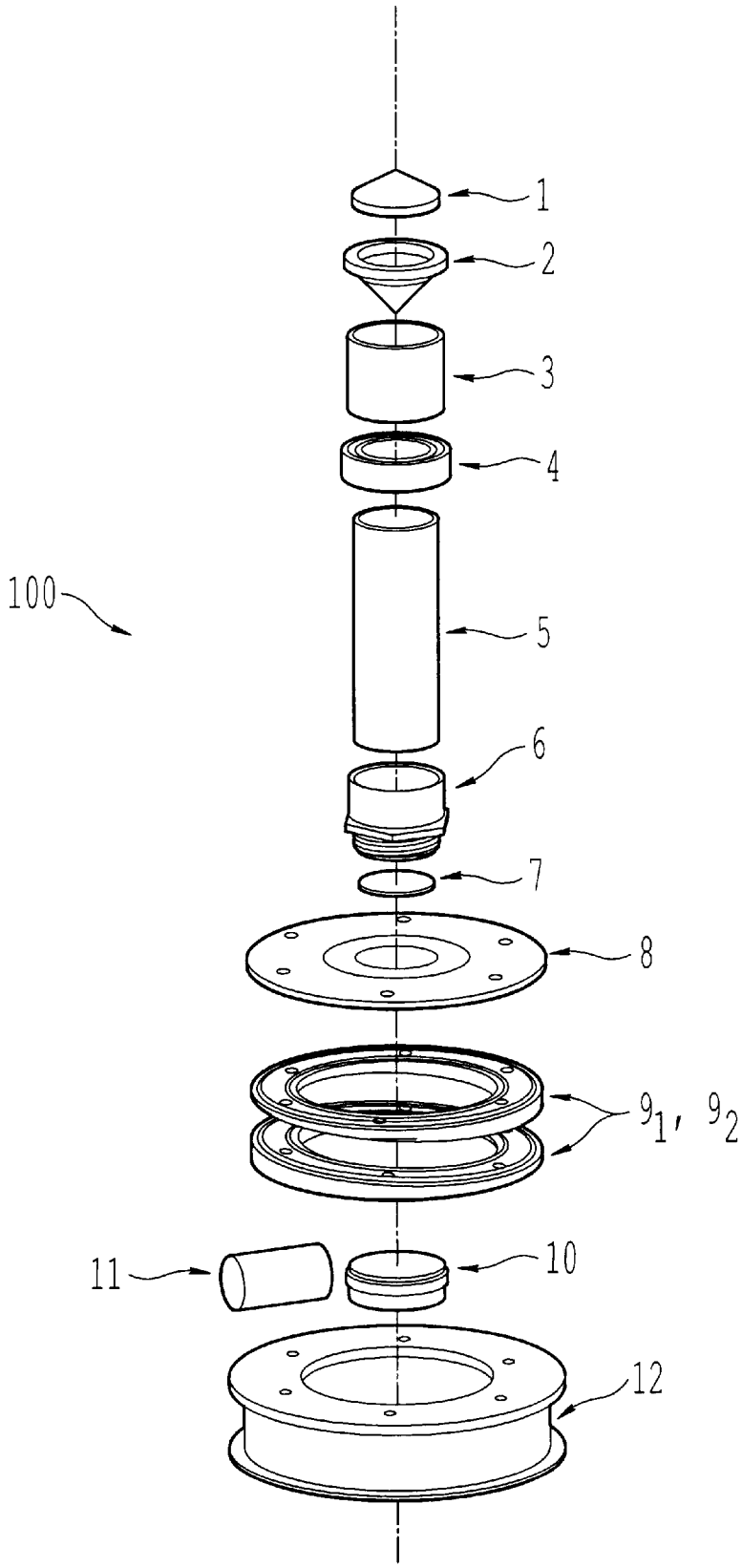
FIG. 2 shows a novel light of the present invention in an exploded view.
Figure 3:
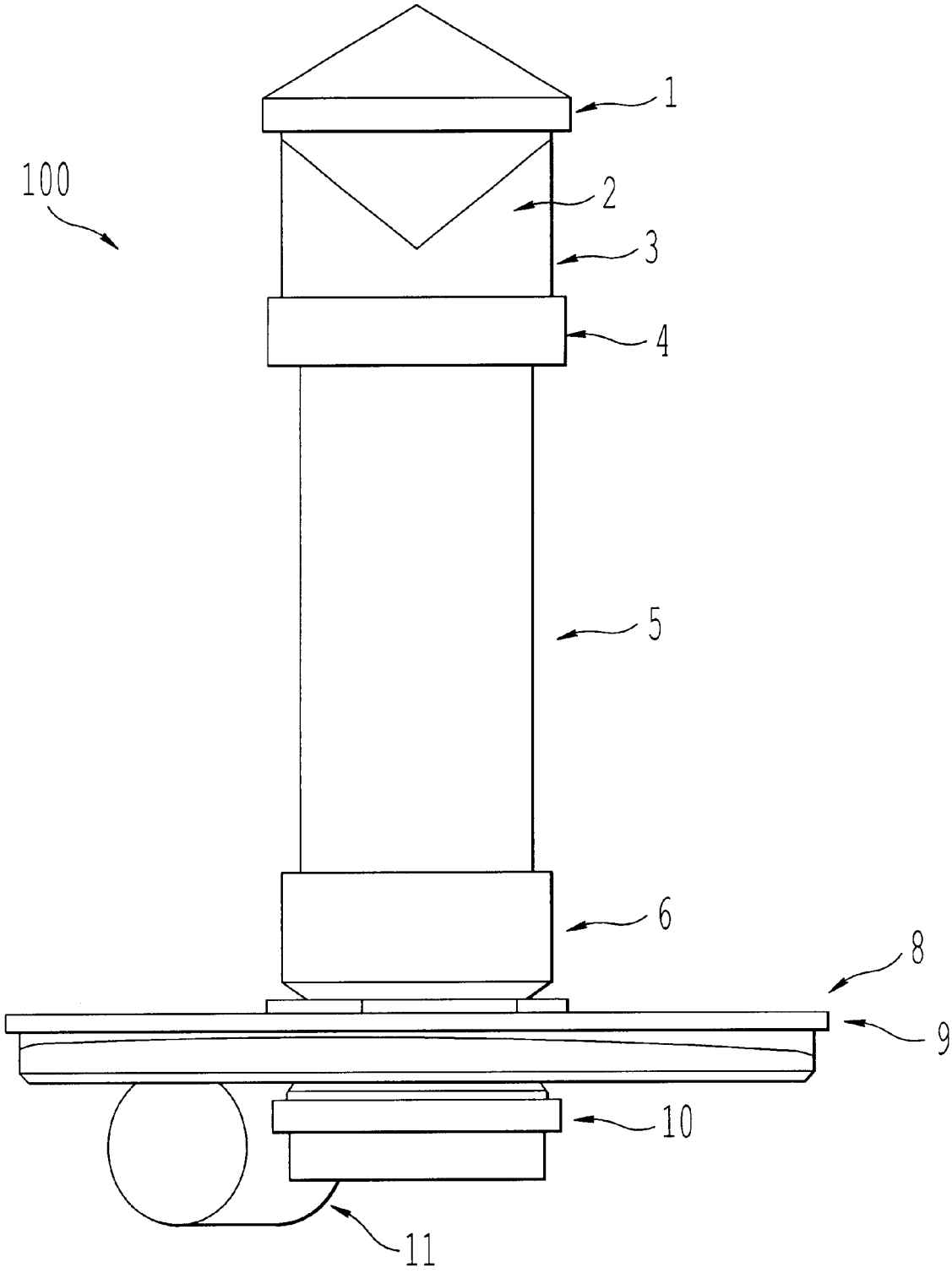
FIG. 3 shows the novel light of the present invention in a side view.

Referring now to the drawings, wherein like reference numerals designate identical or corresponding parts throughout the several views, and more particularly to FIGS. 1–3 thereof, a structure of the novel light 100 of the present invention is provided.

As discussed above, conventional edge lights, such as airport taxiway edge lights, are provided at an edge of a taxiway and are often struck with vehicles, such as aircraft, snow plows, etc., and then require replacement. Also, conventional edge lights utilize incandescent light bulbs which are not highly energy efficient and which have short lifetimes.

The light 100 of the present invention provides advantages in requiring replacement far less often from conventionally burning out, increasing energy efficiency, and simplifying replacement when struck by vehicles.

The light 100 of the present invention is shown in detail in FIGS. 1–3. As shown in FIGS. 1–3, the light 100 includes a base plate 8. The base plate 8 is mounted above an in-ground junction box 12 on top of two tapered gaskets 91, 92. As shown further in FIGS. 2 and 3, a light engine 10 and power supply assembly 11 are mounted on the bottom surface of the base plate 8. The base plate 8 is secured to the in-ground junction box 12 such that the light engine 10 and power supply assembly 11 are contained within the protected volume of the in-ground junction box 12.

One feature in the present invention is that the light source for the edge light 100 can include a plurality of LEDs, such as for example blue LEDs. That is, the light engine 10 can include a plurality of LEDs as the light source for the edge light 100. The light engine 10 is a hermetically sealed module containing the LEDs mounted on a small circular printed circuit board. As one specific example, the light 100 can use 69 LEDs with Part No. NSBP500S manufactured by Nichia. Of course different amounts and different types of LEDs could be utilized. The light engine 10 can be powered by any standard power supply assembly 11 designed for powering LEDs. The power supply assembly 11 could also be mounted within a module containing light engine 10. Utilizing LEDs as the light source provides several advantages over edge lights using conventional incandescent lamps.

A first advantage of utilizing LEDs as the light source is that LEDs generally have a significantly longer life than incandescent lamps. Therefore, the light 100 of the present invention will require general replacement for burning out much less frequently than a convention incandescent lamp edge light to reduce maintenance costs. A second advantage of utilizing LEDs is that LEDs are inherently more energy efficient than incandescent lamps, and thus the light 100 of the present invention provides the advantage of reducing operating costs.

However, it is noted that utilizing LEDs as the light source does have one drawback, namely that LEDs are significantly more expensive than incandescent lamps. Therefore, the initial cost of utilizing the light 100 of the present invention would be significantly higher than that of an edge light which utilizes a conventional incandescent lamp. Such a factor would be particularly worrisome in edge lights which are often struck by vehicles and thus would require complete replacement. That is, in a situation in which an edge light was struck by a vehicle, such as an airplane or a snow plow, the edge light would have to be entirely replaced. Requiring total replacement often would cause customers to shy away from purchasing LED based lights because of their significantly higher up front cost in comparison with convention incandescent lamp based edge lights.

However, the structure of the novel light 100 of the present invention addresses that potential drawback by ensuring that the expensive LED components are not located at a position where they would be struck by a vehicle, and thus would not need to be replaced.

Again with reference to FIGS. 1–3, the base plate 8 covers the light engine 10 and power supply assembly 11 so that those elements are housed in the in-ground junction box 12 and to thereby be under the ground level. That is, in the light 100 of the present invention the in-ground junction box 12 is positioned below ground and the base plate 8 is designed to be positioned at ground level. With such a structure in the light 100, if a vehicle such as an airplane or snow plow strikes the light 100, the in-ground junction box 12 containing the expensive LEDs and drive circuitry would not be struck, and the LEDs and drive circuitry would not be damaged.

The light 100 of the present invention also utilizes a specific structure to ensure that it provides an appropriate amount of illumination from the LED light sources which are below ground level.

As shown in FIGS. 1–3, the light 100 of the present invention includes a light guide which extends out above the base plate 8 and the in-ground junction box 12. That light guide includes an opaque tube section 5, such as a PVC Schedule 40 pipe, an acrylic tube, a metallic tube, etc. When the light 100 is utilized as an edge light at an airport, as one example, the tube section 5 should be opaque to prevent light from leaking out of the tube section 5. In the case of a taxiway edge light for FAA approved applications, all external surfaces must be yellow in color to provide identification as a marker. To provide a yellow exterior surface, the tube section 5 can be painted yellow, but paint is subject to abrasion and impact damage. To provide a permanent color not subject to being abraded, a coloring can also be added to plastic resin forming the tube section 5 during an extrusion process. That would provide a desired color all the way through the tube section 5 but which does not have any control in providing the appropriate illumination.

The bottom of the tube section 5 is connected to the base plate 8 through a frangible coupling 6, and further can contain a transparent window 7.

The use of the transparent window 7 can provide an interior of the tube assembly, containing the optical path and a reflector, with a hermetic environment. Such a sealing prevents spiders, bugs, etc. from making a home in the light 100. Also, the transparent window 7 providing the hermetic seal prevents water vapor from condensing at an inner surface of the tube section 5 and cylindrical window 3, to prevent obscuring of required output light. All of the above ground portion of the light 100 can be formed with the same hermetically sealed assembly and can be adhesively bonded during production.

Figure 4:
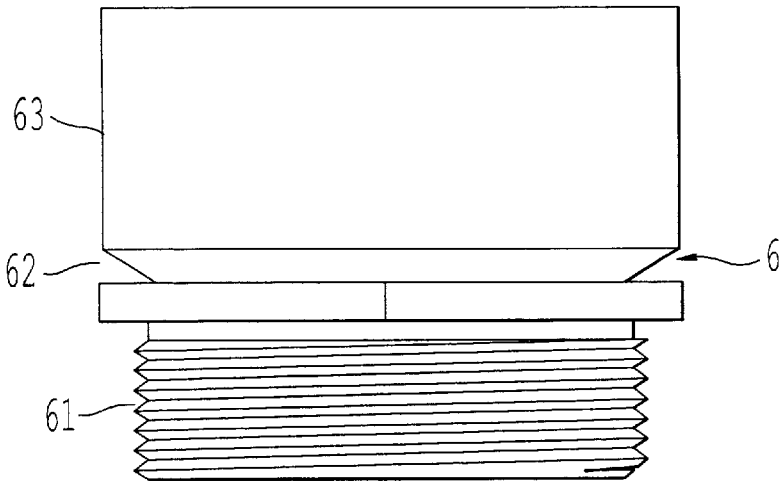
FIG. 4 shows a frangible coupling of the novel light of the present invention.

The frangible coupling 7 is shown in detail in FIG. 4 and is designed to break away from the in-ground junction box 12 when a force exceeding a threshold is exerted thereon. Thereby, if a vehicle such as an airplane or snow plow strikes the tube section 5, the tube section 5 will break away from the in-ground junction box 12 at the frangible coupling 6. In such an instance, only the above ground portion of the light 100 will need replacement and the more expensive LED elements in the light engine 10 and the driving circuitry of the power supply assembly 11 housed in the in-ground junction box 12 will not need replacement.

As shown in further detail in FIG. 4, the frangible coupling 6 includes a threaded portion 61 for mounting into the in-ground junction box 12 and a tube portion 63 into which the tube section 5 is slid. In production, the tube section 5 is slid into the frangible coupling 6 and is secured in place with, e.g., a solvent welding chemical, a mechanical bonding agent (adhesive or sealant), etc. Further, the frangible coupling 6 includes a circumferential groove 62. That circumferential groove 62 operates as a defined break point at which the tube portion 63 will break away. Thus, if the light 100 is struck by a vehicle, the frangible coupling 6 will break at the circumferential groove 62. Thus, only those portions from the frangible coupling 6 and above, i.e. the above ground portion of the light 100, will need replacement.

Further, with the structure in the present invention all of the drive circuitry and LEDs are housed in the in-ground junction box 12 and no wirings extend into the tube section 5. As a result, if the tube section 5 is broken off at the in-ground junction box 12 no wirings will be exposed. That is another drawback with conventional incandescent edge lights which upon being damaged may have exposed line voltage wirings in an area which is susceptible to fuels, oils, etc.

Figure 5:
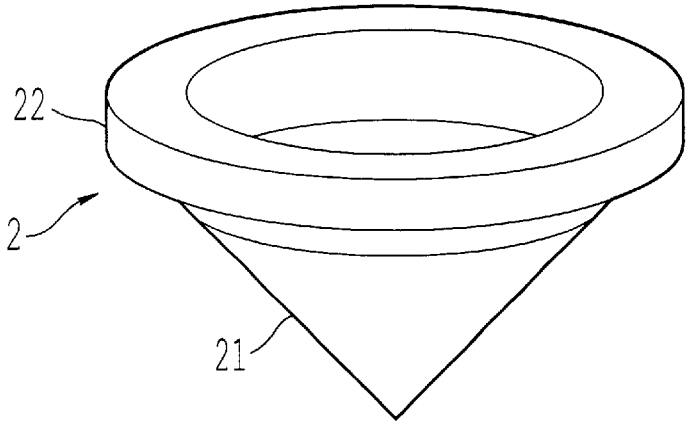
FIG. 5 shows the reflector of the light of the present invention.

Moreover, to ensure that the light 100 provides an appropriate amount of illumination, the light 100 may include a reflector 2 provided at a top portion thereof. As shown in FIGS. 1–3 formed atop the tube section 5 is the cylindrical window 3, reflector 2, and top cap 1. The reflector 2 may be a separate component which forms a part of the overall tube assembly and may be placed on top, and bonded to, the cylindrical window 3, and the top cap 1 is placed on top, and bonded to, the reflector 2. The cylindrical window 3 is connected to the tube section 5 by the joint ring 4. The reflector 2 is shown in further detail in FIG. 5. The reflector 2 may be an injected molded acrylic part which is vacuum metallized. The reflector 2 has a conical lower portion 21 and a cylindrical upper portion 22. The reflector 2 is not, however, limited to having a conical lower portion 21 and cylindrical upper portion 22, and then in other cases as desired, the reflector 2 may be a planar reflector, or can have another mathematically described surface. Further, if light is desired to exit out the top of the reflector 2 a hole may be provided through the center of the reflector's 2 coating. The top cap 1 provides an anti-bird roost, prevents snow and water accumulation, and provides esthetic appeal, and the reflector 2 can be designed to achieve such functions making the top cap 1 unnecessary.

The use of such a reflector 2 allows light to be guided through the light 100 in the upward direction shown in FIGS. 1–3 and then to be reflected out of the reflector 2 in a perpendicular direction to the tube section 5. Such an operation allows the edge light 100 to provide an appropriate amount of illumination and to meet FAA standards when utilized as an airport taxiway edge light.

Also located and bonded to the top of the reflector 2 is a top cap 1. The top cap 1 may be also be opaque or translucent to allow light to be emitted through the top as desired.

In addition, and independent of being opaque or transparent, the top cap 1 may be colored, for example it may be colored blue, to provide a visional indication of an operational color of the light even when the light is not illuminated.

Figure 6:
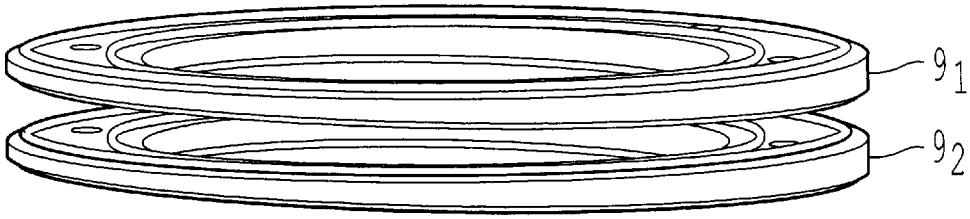
FIG. 6 shows tapered gaskets utilized in the light of the present invention.

Underneath the in-ground junction box 12, between it and the existing ground fixture, two tapered gaskets $\mathbf{9}_1$, $\mathbf{9}_2$ of varying thicknesses around their circumference may be provided to allow adjustment within a 4 degree band to level the orientation of the light 100 during installation by rotating the two tapered gaskets $\mathbf{9}_1$ and $\mathbf{9}_2$ relative to each other. The tapered gaskets $\mathbf{9}_1$, $\mathbf{9}_2$ are shown in detail in FIG. 6. By utilizing the two tapered gaskets 91, 92, the long vertical axis of the light 100 can be oriented to a truly vertical position even if the in-ground junction box 12 does not have a perfectly horizontal mounting surface with respect to "true level".

Further, the power supply assembly 11 that may be in the in-ground junction box 12 may be provided so that the in-ground junction box 12 can be easily retrofited on existing incandescent power sources.

In a typical existing airport installation, the in-ground junction box 12 contains a connector terminated isolation transformer. A conventional incandescent fixture includes a mating connector on one end of a suitable length flying lead. That mating connector plugs into the transformer connector, providing power to the incandescent lamp. In the light 100 of the present invention, a flying lead with the same termination is connected to the power supply assembly 11. The power supply assembly 11 is hardwired to and provides power to the light engine 10. As a result, as both the conventional incandescent lamp and the light 100 are connectorized properly, replacement simply is a matter of un-plug and re-plug.

As noted above, the drive circuitry for the LEDs is located in the in-ground junction box 12. That drive circuitry may be any conventional drive circuitry designed to power LEDs and can include any of power factor correction, voltage regulation, current regulation, etc.

With such a structure in the present invention, the light 100 is energy efficient, requires less routine maintenance by requiring less routine replacement, provides easy replacement if struck by a vehicle, and prevents its wires from being exposed if struck.

Obviously, numerous modifications and variations of the present invention are possible in light of the above teachings. It is therefore to be understood that within the scope of the appended claims, the invention may be practiced otherwise than as specifically described herein.

What is claimed is:

1. A light comprising:

a) a base including an in-ground portion configured to be mounted below a ground level and including a light source provided in the in-ground portion and configured to output light;

b) a light guide extending out from said in-ground portion and configured to receive and guide the light output from said light source;

c) a reflector positioned in said light guide and configured to reflect the light guided through said light guide.

2. A light according to claim 1, wherein said light source comprises at least one light emitting diode.

3. A light according to claim 1, wherein said light guide is formed of an opaque tube.

4. A light according to claim 1, wherein said reflector comprises a conical lower section and a cylindrical upper section positioned atop said conical lower section.

5. A light according to claim 1, further comprising d) a frangible coupling configured to couple said light guide to said base.

6. A light according to claim 5, wherein said light source comprises at least one light emitting diode.

7. A light according to claim 5, wherein said light guide is formed of an opaque tube.

8. A light according to claim 5, wherein said reflector comprises a conical lower section and a cylindrical upper section positioned atop said conical lower section.

9. A light according to claim 1, further comprising d) a lens cover positioned on top of said reflector.

10. A light according to claim 5, further comprising d) a lens cover positioned on top of said reflector.

11. A light according to claim 1, further comprising d) at least one tapered gasket provided at a bottom of said base to adjust an orientation of said base.

12. An airport taxiway edge light comprising:

a) a base including an in-ground portion configured to be mounted below a ground level and including a light source provided in the in-ground portion and configured to output light;

b) a light guide configured to receive and guide the light output from said light source and to extend above the in-ground portion from said light source;

c) a reflector positioned in said light guide and configured to reflect the light guided through said light guide.

13. An airport taxiway edge light according to claim 12, wherein said light source comprises a1) at least one light emitting diode.

14. An airport taxiway edge light according to claim 12, wherein said light guide is formed of an opaque tube.

15. An airport taxiway edge light according to claim 12, wherein said reflector comprises a conical lower section and a cylindrical upper section positioned atop said conical lower section.

16. An airport taxiway edge light according to claim 12, further comprising d) a frangible coupling configured to couple said light guide to said base.

17. An airport taxiway edge light according to claim 16, wherein said light source comprises at least one light emitting diode.

18. An airport taxiway edge light according to claim 16, wherein said light guide is formed of an opaque tube.

19. An airport taxiway edge light according to claim 16, wherein said reflector comprises c1) a conical lower section and c2) a cylindrical upper section positioned atop said conical lower section.

20. An airport taxiway edge light according to claim 12, further comprising d) a lens cover positioned on top of said reflector.

21. An airport taxiway edge light according to claim 16, further comprising d) a lens cover positioned on top of said reflector.

22. An airport taxiway edge light according to claim 12, further comprising d) at least one tapered gasket provided at a bottom of said base to adjust an orientation of said base.

23. A light comprising:

a) base means including an in-ground housing means configured to be mounted below a ground level and including a light source provided in the in-ground means for outputting light;

b) light guide means for receiving and guiding the light output from said light source means;

c) reflector means for reflecting the light guided through said light guide means.

24. A light according to claim 23, further comprising d) frangible coupling means for coupling said light guide to said base.

25. A light according to claim 23, further comprising d) lens cover means for covering a top of said reflector means.

26. A light according to claim 24, further comprising d) lens cover means for covering a top of said reflector means.

27. A light according to claim 23, further comprising d) means for adjusting an orientation of said base means.

* * * * *